United States Patent [19]

Handler et al.

[11] Patent Number: 4,625,604

[45] Date of Patent: Dec. 2, 1986

[54] SPLITTER AND BLADE GUARD ASSEMBLY

[75] Inventors: Milton E. Handler, Northbrook; Richard Sylvan, Glenview; Herbert Baisch, Palatine, all of Ill.

[73] Assignee: Hirsh Company, Skokie, Ill.

[21] Appl. No.: 741,746

[22] Filed: Jun. 10, 1985

[51] Int. Cl.[4] ..... B27B 5/06

[52] U.S. Cl. ..... 83/102.1; 83/478; 83/DIG. 1

[58] Field of Search ..... 83/102.1, 478, 472, 83/473, 477.1, 477.2, 574, DIG. 1

[56] References Cited

U.S. PATENT DOCUMENTS

| | | | |
|---|---|---|---|
| D. 261,712 | 11/1981 | Ferdinand et al. | D6/178 |
| D. 266,128 | 9/1982 | Ferdinand et al. | D6/178 |
| 545,504 | 9/1895 | Hoover | 83/102.1 |
| 2,095,330 | 10/1937 | Hedgepeth | 83/478 X |
| 3,577,316 | 5/1971 | Piette | 403/381 X |
| 4,362,196 | 12/1982 | Ferdinand et al. | 144/286 R |

OTHER PUBLICATIONS

Black and Decker Owner's Manual 8" Table Saw 9419.
Wen Owner's Manual for all Saw Table Model 4535 and Model 4535CSA.
Sears Owner's Manual for Model No. 113.221610 Table Saw.
Vermont American Hardware Tool Division Owner's Assembly and Operation Manual for Deluxe Circular Portable Saw Table No. 398.
Sears Craftsman Instructions for Assembly and Operation of your Deluxe Circular Saw Table 925965.
Sears Owner's Manual 9 25963.
Hirsh Saw Table Assembly Instructions and Usage Manual 6Q0014 1784.
Manual for Central Quality Industries, Inc. POW-R--TOOL TABLE.
AMT Operating Instructions for Bench Saw Model 2165 and 2164 Series.

*Primary Examiner*—James M. Meister
*Assistant Examiner*—John L. Knoble
*Attorney, Agent, or Firm*—Dressler, Goldsmith, Shore Sutker & Milnamow, Ltd.

[57] ABSTRACT

A guide member projects upwardly from the splitter, and an extension bracket is pivotally connected to the splitter and defines a guide slot for receiving the guide member. The splitter includes a leg having a projecting foot defining a notch between the foot and a bottom portion of the splitter whereby the leg may be disposed within a slot in a mounting plate so that the notch receives a portion of the mounting plate. The mounting plate includes a tab angled downwardly at one side of the slot for engaging a side of the foot.

13 Claims, 7 Drawing Figures

SPLITTER AND BLADE GUARD ASSEMBLY

TECHNICAL FIELD

This invention relates to apparatus used in conjunction with a portable power circular saw wherein the saw is mounted in a table top.

BACKGROUND OF THE INVENTION AND TECHNICAL PROBLEMS POSED BY THE PRIOR ART

Table assemblies have been provided for supporting portable power circular saws in a position whereby they may function as a conventional table power circular saw. Such devices have included guard hoods for covering the saw blade and preventing accidental contact with the saw blade. Such devices have also included a splitter for entering into the workpiece kerf as the workpiece is fed past the splitter.

Many conventional prior designs are typically limited with respect to the thickness of the workpiece that can be accommodated. It would be desirable to provide an improved device that could accommodate workpiece of increased thickness.

With some types of conventional prior devices, it is possible to orient the splitter at an angle with respect to the table top for bevel cutting. However, it is difficult to maintain such devices within the desired tolerances to effect extremely accurate bevel cutting. It would be desirable to provide an improved design that would permit more accurate bevel cutting.

SUMMARY OF THE INVENTION

An improved splitter and blade guard assembly is provided for use with a table top for supporting a portable power circular saw. The assembly includes (1) a mounting plate for mounting the saw to the table top and a first slot for receiving the circular saw blade of the saw; (2) a splitter for entering into the workpiece kerf as the workpiece is fed past the splitter; (3) splitter mounting means for mounting the splitter to the table top in alignment with the mounting plate first slot; (4) an extension bracket pivotally mounted to the splitter; and (5) a guard hood pivotally mounted to the extension bracket and extending over the mounting plate first slot. This assembly is improved in that the splitter includes an upwardly projecting guide member and the extension bracket defines a guide slot for receiving the guide member. This accommodates workpieces of increased thickness while insuring that the guard hood remains aligned with the saw blade.

Another feature of the assembly resides in the provision of a second slot in the mounting plate and the provision of a leg on the splitter having a projecting foot defining a notch between the foot and the bottom of the splitter whereby the leg may be disposed within the second slot with the notch receiving a portion of the mounting plate.

A further feature which may be provided according to the teachings of the present invention is the provision in the mounting plate of a tab angled downwardly at one side of the second slot for engaging a side of the foot.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, used, and sold in an orientation other than the position described.

The apparatus of this invention is used with certain conventional components the details of which, although not fully illustrated or described, will be apparent to those having skill in the art and an understanding of the necessary functions of such components.

Figure 1:
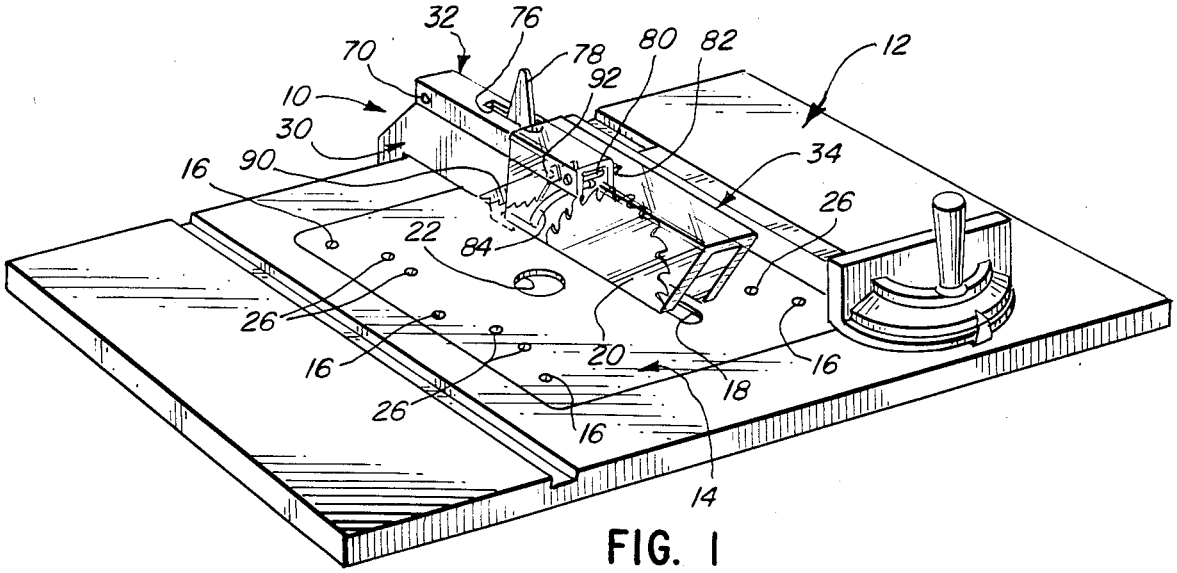
FIG. 1 is a perspective view of the improved splitter and blade guard assembly of the present invention shown mounted to a table top for supporting a portable power circular saw.

A first embodiment of the improved splitter and blade guard assembly of the present invention is illustrated in FIG. 1 and designated therein generally by the reference numeral 10. The assembly 10 is adapted for use with a suitable table top 12 and includes a saw mounting plate 14 which is mounted in the table top 12.

The table top 12 is fabricated from a suitable material, typically particle board or the like. The saw mounting plate 14 is typically secured to the table top 12. To this end, as best illustrated in FIG. 2, the saw mounting plate 14 can be provided with a plurality of peripheral apertures 15 for receiving screws 16 (FIG. 1).

Figure 2:
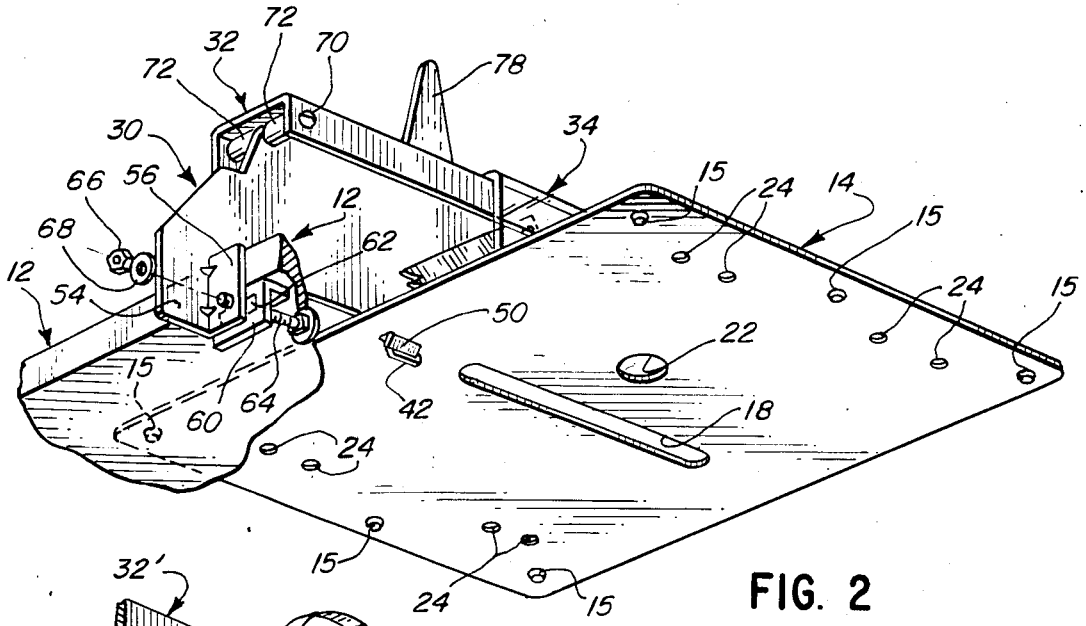
FIG. 2 is a perspective view of the assembly shown in FIG. 1, but viewed from the bottom with a portion of the table top broken away to illustrate certain details and with a nut and washer illustrated in exploded perspective.

As best illustrated in FIGS. 1 and 2, the saw mounting plate 14 is also provided with a slot 18 for receiving the blade 20 of the portable power circular saw. Another tool receiving aperture, such as bore 22, may be provided for use with other tools, such as a router or saber saw (not illustrated).

The saw mounting plate 14 may also be provided with suitable conventional or special means for mounting the portable power circular saw and other tools thereto. One such conventional mounting means includes a plurality of apertures 24 defined in the saw mounting plate 14 (FIG. 2) for receiving screws 26 (FIG. 1) which are threaded to appropriate clamps (not illustrated) for holding the conventional soleplate (not illustrated) of the portable power circular saw to the underside of the mounting plate 14. Typically, an intermediate insert plate (not illustrated), such as a fibreboard member, would be provided between the bottom surface of the saw mounting plate 14 and the portable power circular saw soleplate to provide a flat mounting surface and prevent the possibility of slippage. In any event, the detailed design and specific structure of the conventional means for holding the portable power circular saw and any other power tool to the saw mounting plate 14 forms no part of the present invention.

The table top 12 is typically supported at a convenient working elevation with suitable clearance below the support plate 14 to accommodate the portable power circular saw or other tool mounted to the underside of the saw mounting plate 14. Preferably, the table top 12 is mounted to a suitable leg assembly, framework, or stand (not illustrated). The detailed design and specific structure of such a leg assembly, framework, or stand forms no part of the present invention.

Figure 4:
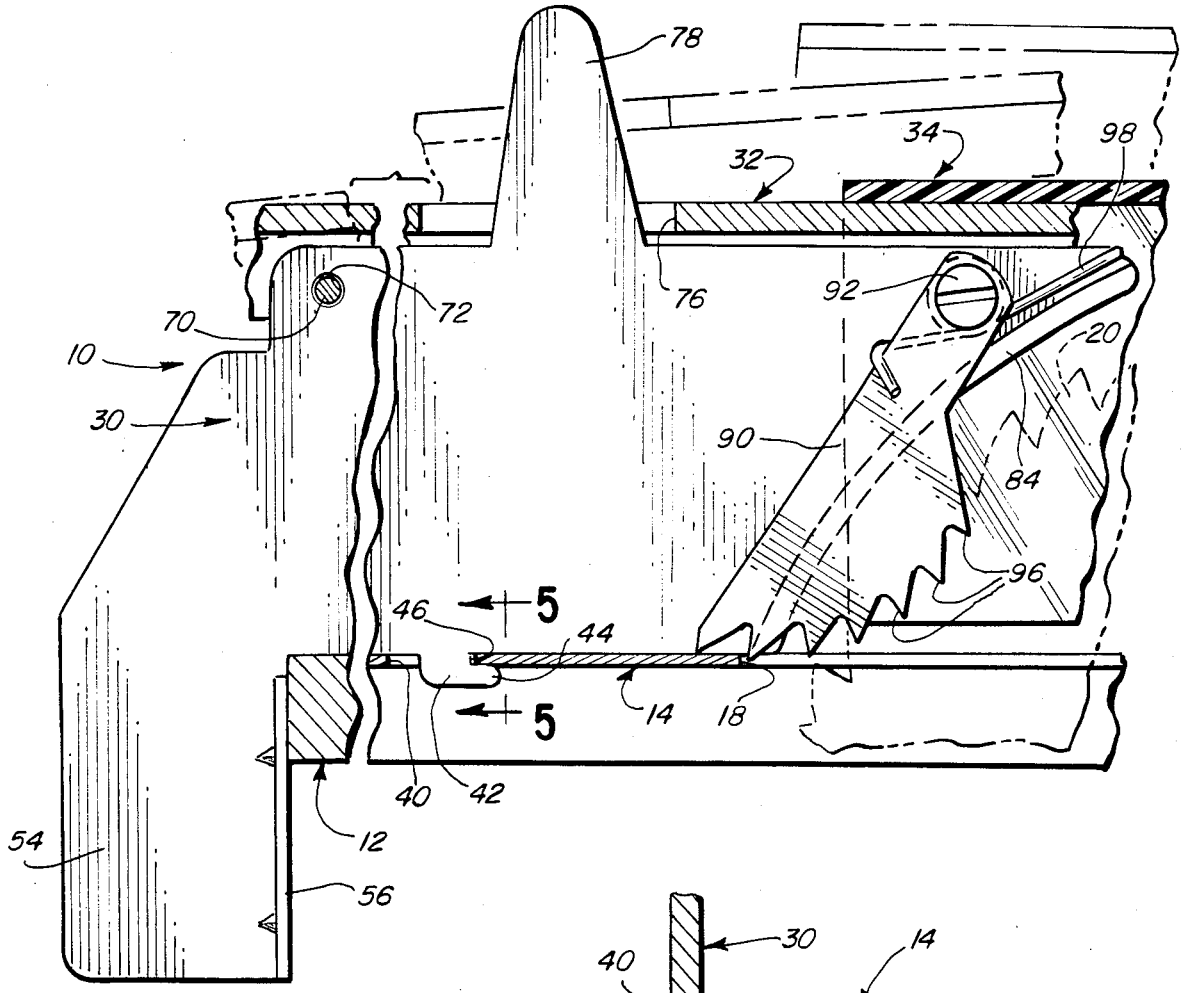
FIG. 4 is a greatly enlarged, fragmentary, cross-sectional view of a portion of the first embodiment of the splitter and blade guard assembly illustrated in FIGS. 1 and 2, it being realized that an elevated position of the guard hood and extension bracket are illustrated in phantom by dashed lines.

As best illustrated in FIGS. 1, 2 and 4, the assembly 10 includes a splitter 30 on the table top 12, an extension bracket 32 pivotally mounted to the splitter 30, and a guard hood 34 pivotally mounted to the extension bracket 32 for extending over the slot 18 in the mounting plate 14. These components are next discussed in more detail.

As best illustrated in FIGS. 2 and 4, the splitter 30 is a generally plate-like member which is mounted in a vertical plane relative to the saw mounting plate 14. The bottom edge of the splitter 30 rests on the top surface of the mounting plate 14, and further, the splitter 30 is actually engaged with the mounting plate 14.

Figure 5:
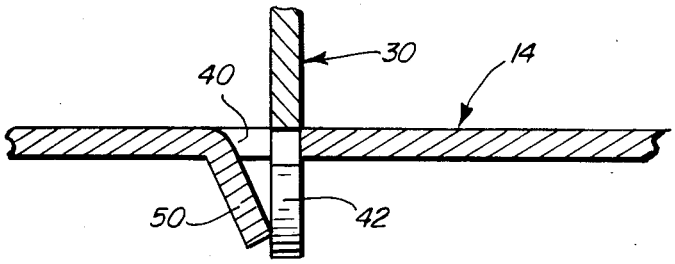
FIG. 5 is a greatly enlarged, fragmentary, cross-sectional view taken generally along the plane 5—5 in FIG. 4.
Figure 6:
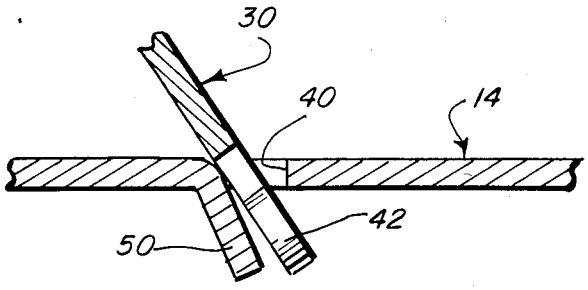
FIG. 6 is a view similar to FIG. 5 but showing the splitter at an angled orientation relative to the saw plate for use in bevel cutting.

To this end, the mounting plate 14 defines a slot 40 (FIGS. 4–6). The splitter 30 includes a leg 42 having a projecting foot 44 (FIG. 4). A notch 46 is defined above the foot 44 below the bottom of the adjacent portion of the splitter 30. Thus, the splitter 30 may be mounted with the leg 42 disposed within the slot 40 and with the notch 46 receiving a portion of the mounting plate 14. The slot 40 is long enough to accommodate insertion and removal of the leg 42.

As best illustrated in FIGS. 2, 5, and 6, the mounting plate 14 also includes a tab 50 angled downwardly at one side of the slot 40 for engaging a side of the splitter foot 42. In the embodiment illustrated, the tab is angled at about 67 degrees from the surface of the mounting plate 14. This accommodates positioning of the splitter 30 in the normal vertical orientation as illustrated in FIG. 5 and also accommodates an angled orientation as illustrated in FIG. 6. When it is desired to make a bevel cut in a workpiece, the splitter 30 can be tilted at an angle (such as the selected angle illustrated in FIG. 6) by means described hereinafter.

It is to be noted that, with reference to FIG. 5, when the splitter 30 is in the vertical orientation, one side of the leg 42 of the splitter 30 bears against an edge of the slot 40 while the other side of a lower portion of the leg 42 bears against the end of the mounting plate tab 50. This serves to define the true vertical orientation when the normal vertical cut is being made in a workpiece. In this orientation illustrated in FIG. 5, the splitter 30 and the saw blade 20 would be aligned in vertical registry.

The splitter 30, at its rearward end, has a downward extension 54 (FIG. 2) for engaging a splitter mounting means comprising (1) a first angle bracket 56 forming part of, or secured to, the splitter 30 and defining a bore therethrough, (2) a second angle bracket 60 for being mounted to the underside of the table top 12 and defining an elongate aperture 62 therethrough, (3) a carriage bolt 64 for extending through both the first angle bracket bore and the second angle bracket elongate aperture in such a manner that the square neck portion of the carriage bolt 64 is received within the second bracket elongate aperture 62 to prevent rotation of the bolt 64 while accommodating lateral or axial displacement thereof, and (4) a nut 66 for being threadingly engaged with the distal end of the carriage bolt 64 adjacent the first angle bracket 56. Preferably, a washer 68 is also disposed between the nut 66 and the first angle bracket 56. The second angle bracket 60 is secured to the underside of the table top 12 by suitable means (such as screws (not illustrated)).

By loosening the nut 66, the bracket 56 may be rotated about the carriage bolt 64 as desired to orient the splitter 30 at a selected angle (e.g., as in FIG. 6). Retightening of the nut 66 secures the splitter 30 at the selected angle.

At the top of the splitter 30, the extension bracket 32 is mounted to the upper portion of the splitter 30 by means of a screw 70 and nut (not visible in the Figures). Proper positioning of the extension bracket 32 on the splitter 30 is provided by the use of spacers 72 on the screw 70 on either side of the splitter 30.

As best illustrated in FIGS. 1 and 4, the extension bracket 32 defines a guide slot 76 in a horizontal portion over the splitter 30. The splitter 30 includes an upwardly projecting guide member 78 which is received in the guide slot 76. Thus, when the extension bracket is pivoted upwardly about screw 70 (to the elevated position illustrated in phantom lines in FIG. 4), the guide member 78 of the splitter 30 prevents unwanted lateral displacement of the extension bracket 32.

As best illustrated in FIG. 1, the guide hood 34 is pivotally mounted to the front portion of the extension bracket 32 by means of a screw 80 secured on one end with a nut 82. Preferably, the guide hood 34 is fabricated from a transparent material, such as a thermoplastic material, and has a channel-like configuration for enclosing the saw blade 20 on each side.

The front of the splitter 30 includes a distal end 84 (FIG. 4) defining an arcuate recess for accommodating the saw blade 20. The assembly 10 also includes a pair of workpiece-gripping pawls 90 pivotally mounted to the splitter 30 between the splitter guide member 78 and the recess at the distal end 84. One pawl 90 is provided on each side of the splitter 30 and both are pivotally mounted to the splitter 30 by means of a screw 92. Each pawl 90 has a plurality of downwardly directed teeth 96 for engaging a workpiece when a workpiece is present and for resting on the upwardly facing surface of the mounting plate 14 in the absence of a workpiece. Each pawl 90 is biased downwardly towards the mounting plate 14 by means of a spring 98.

With reference to FIG. 4, it can be seen that the splitter distal end 84, which defines the arcuate recess for accommodating the saw blade 20, projects over the slot 18 in the mounting plate 14. Further, a portion of each pawl 90 overhangs the mounting plate 14 adjacent the slot 18. It has been found that this design is particularly effective in permitting the splitter 30 to easily enter into the kerf of the workpiece to guide the workpiece along the splitter 30 and is particularly effective in permitting the pawls 90 to engage the workpiece in a manner that resists kickback of the workpiece owing to rotation of the saw blade 20.

Figure 7:
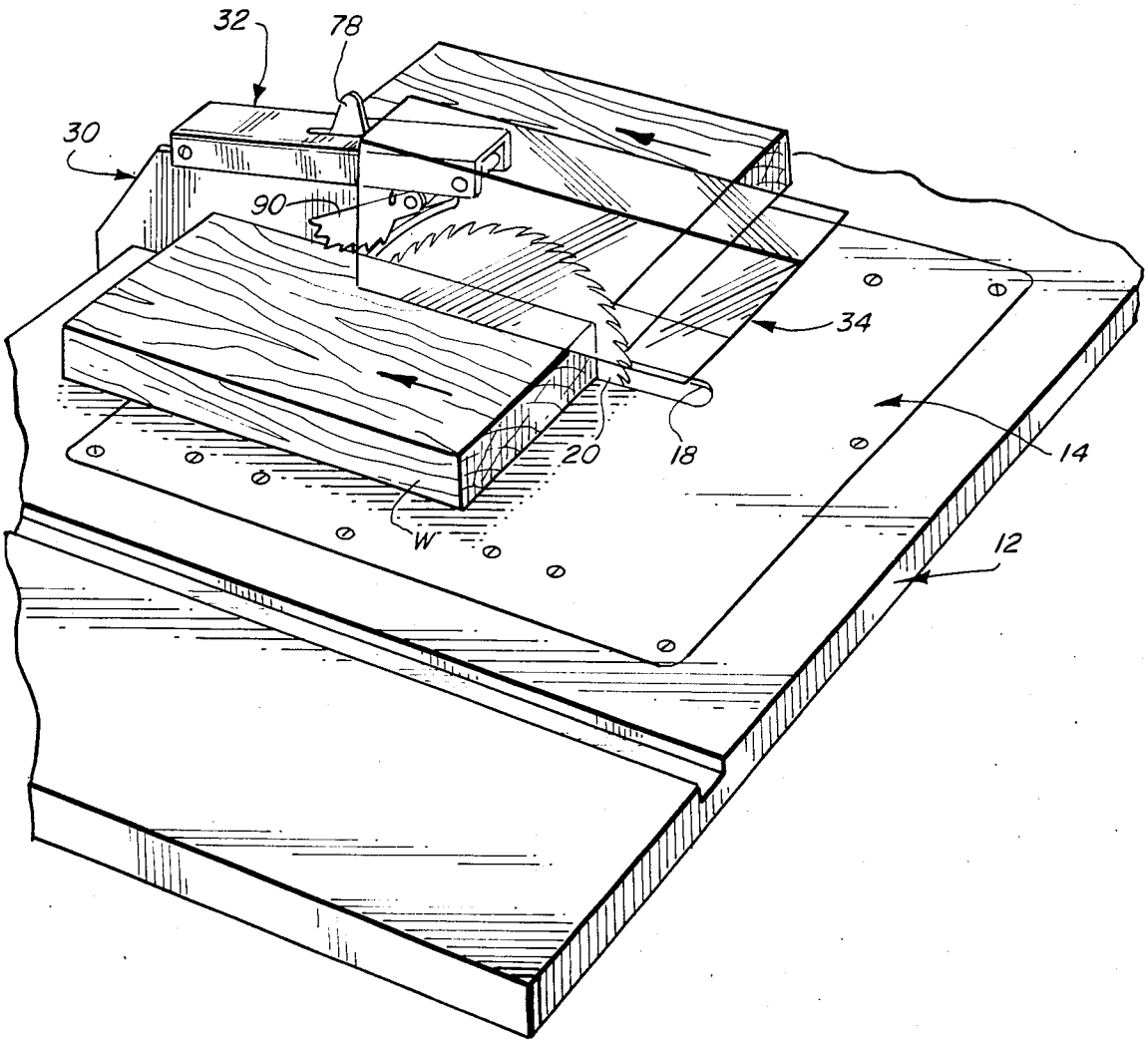
FIG. 7 is a fragmentary, perspective view similar to FIG. 1 but showing the position of the components when a workpiece is being cut.

Use of the novel apparatus of the present invention is illustrated in FIG. 7. A workpiece W is shown being cut by the saw blade 20. The extension bracket 32 pivots upwardly to accommodate the elevation of the guard hood 34 as it rides on the upper surface of the workpiece W. The splitter 30 enters into the kerf of the cut, and the pawls 90 engage the top of the workpiece W to prevent the workpiece W from being kicked forward by the action of the saw blade 20.

Figure 3:
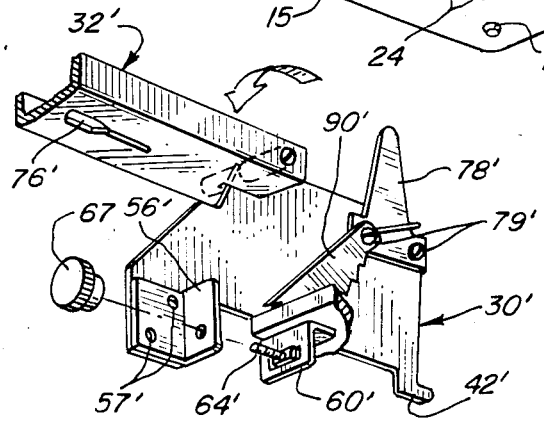
FIG. 3 is a view similar to FIG. 2, but of an alternate embodiment shown with the saw plate omitted to better illustrate certain details, with the guard hood extension bracket rotated rearwardly and partially broken away, and with the splitter adjustment knob shown in exploded perspective.

An alternate embodiment of the splitter and blade guard assembly is illustrated in FIG. 3. The alternate embodiment illustrated in FIG. 3 has a separate mounting bracket 56' secured with appropriate screws 57' to the flat plate splitter 30'. The splitter 30' is mounted by means of the bracket 56' to a second bracket 60' with a carriage bolt 64' and a knob 67.

In the alternate embodiment illustrated in FIG. 3, the splitter 30' has a foot 42' located at the forward end of the splitter 30' rather than towards the rearward end of the splitter as in the first embodiment described above with reference to FIGS. 1, 2, and 4–7.

The flat plate splitter 30' is provided with an upwardly projecting guide member 78' that is not unitary with the splitter 30'. Rather, the guide member 78' is mounted with suitable screws 79' to the splitter 30'.

An extension bracket 32' is pivotally mounted to the top of the splitter 30' and has a slot 76' located to be in alignment with, and receive, the guide member 78'.

One of the two mounting screws 79' also functions to mount the pawls 90'. In contrast with the first embodiment described above with reference to FIGS. 1, 2, and 4–7, the pawls 90' in this alternate embodiment are located between the guide member 78' and the rear end of the splitter 30' rather than forward of the guide member 78'. It is also to be noted that the front end of the splitter 30' extends generally vertically upwardly and does not define an arcuate recess for receiving a saw blade as in the first embodiment.

While this alternate embodiment functions satisfactorily, it would be preferable, for most applications, to mount the pawls forward of the guide member as in the first embodiment and to provide the forward end of the splitter with an arcuate recess for receiving the saw blade in close proximity as in the first embodiment.

It will be readily observed from the foregoing detailed description of the invention and from the illustrated embodiments thereof that numerous variations and modifications may be effected without departing from the true spirit and scope of the novel concepts or principals of this invention.

What is claimed is:

1. In a splitter and blade guard assembly for use with a table top for supporting a portable power circular saw, said assembly having (1) a mounting plate for mounting said saw on said table top and having a first slot for receiving the circular saw blade of said saw; (2) a splitter for entering into the workpiece kerf as the workpiece is fed past said splitter; (3) splitter mounting means for mounting said splitter to said table top in alignment with said mounting plate first slot; (4) an extension bracket pivotally mounted to said splitter; and (5) a guard hood pivotally mounted to said extension bracket to accommodate pivoting movement relative to said extension bracket and having a distal end portion extending over said mounting plate first slot; the improvement comprising:

(A) said splitter including an upwardly projecting guide member; and (B) said extension bracket defining a guide slot for receiving said guide member to prevent lateral movement of said extension bracket as said extension bracket pivots upwardly while permitting said guard hood to pivot relative to said extension bracket for accommodating the workpiece.

2. The assembly in accordance with claim 1 in which said mounting plate defines a second slot and in which said splitter includes a leg having a projecting foot defining a notch between said foot and the bottom of said splitter whereby said leg may be disposed within said second slot with said notch receiving a portion of said mounting plate.

3. The assembly in accordance with claim 2 in which said mounting plate includes a tab angled downwardly at one side of said second slot for engaging a side of said foot.

4. The assembly in accordance with claim 3 in which said tab is angled at about 67° from the surface of said mounting plate.

5. The assembly in accordance with claim 1 in which said splitter includes a distal end defining an arcuate recess for accommodating the saw blade of said saw;

in which said assembly further includes at least one workpiece-gripping pawl pivotally mounted to said splitter between said guide member and said recess; and in which said assembly further includes a spring for biasing said pawl toward said mounting plate.

6. The assembly in accordance with claim 5 in which a portion of said pawl overhangs said mounting plate adjacent said first slot.

7. The assembly in accordance with claim 1 in which a portion of said splitter projects over said first slot.

8. In a splitter and blade guard assembly for use with a table top for supporting a portable power circular saw, said assembly having (1) a mounting plate for mounting said saw on said table top and having a first slot for receiving the circular saw blade of said saw; (2) a splitter for entering into the workpiece kerf as the workpiece is fed past said splitter; (3) splitter mounting means for mounting said splitter to said table top in alignment with said mounting plate first slot; (4) an extension bracket pivotally mounted to said splitter; and (5) a guard hood pivotally mounted to said extension bracket and extending over said mounting plate first slot; the improvement comprising:

(A) said mounting plate defining a second slot and including a tab angled downwardly at one side of said second slot;

(B) said splitter being a plate-like member including (1) an upwardly projecting guide member, (2) a downwardly projecting extension for engaging said splitter mounting means, and (3) a leg having a projecting foot with a length less than the length of said second slot, said foot and an adjacent bottom portion of said splitter together defining a notch between said foot and the bottom portion of said splitter whereby said leg may be lowered through said second slot and disposed adjacent said second slot with said notch receiving a portion of said mounting plate; and (C) said extension bracket having a horizontally disposed portion defining a guide slot for receiving said upwardly projecting guide member of said splitter.

9. The assembly in accordance with claim 8 in which said downwardly projecting extension of said splitter includes: a first angle bracket defining a bore therethrough, a second angle bracket for being mounted to the underside of said table top and defining an elongate aperture therethrough, a carriage bolt for extending through said first angle bracket bore and said second angle bracket elongate aperture with the square neck portion of said carriage bolt received within said elongate aperture of said second bracket for preventing rotation thereof while accommodating lateral displacement thereof, and a knob or nut threadingly engaged with the distal end of said carriage bolt adjacent said first angle bracket.

10. The assembly in accordance with claim 8 in which said upwardly projecting guide member is unitary with said splitter.

11. The assembly in accordance with claim 8 in which said splitter includes a distal end defining an arcuate recess for accommodating the saw blade of said saw, said distal end projecting over said first slot in said mounting plate.

12. The assembly in accordance with claim 11 in which said assembly further includes at least one workpiece-gripping pawl pivotally mounted to said splitter between said guide member and said recess and in which said assembly further includes a spring for biasing said pawl toward said mounting plate.

13. The assembly in accordance with claim 12 in which said pawl has downwardly directed teeth for engaging a workpiece when present and for engaging the upwardly facing surface of said mounting plate in the absence of said workpiece.

* * * * *